US011001062B2

(12) United States Patent
Teranishi et al.

(10) Patent No.: US 11,001,062 B2
(45) Date of Patent: May 11, 2021

(54) LIQUID EJECTION HEAD AND A MANUFACTURING METHOD OF THE SAME

(71) Applicant: CANON KABUSHIKI KAISHA, Tokyo (JP)

(72) Inventors: Atsushi Teranishi, Kawasaki (JP); Masaya Uyama, Kawasaki (JP); Takeru Yasuda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/708,836

(22) Filed: Dec. 10, 2019

(65) Prior Publication Data

US 2020/0189275 A1 Jun. 18, 2020

(30) Foreign Application Priority Data

Dec. 17, 2018 (JP) ..... JP2018-235392

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1626* (2013.01)

(58) Field of Classification Search
CPC ..... B41J 2/1433; B41J 2/162; B41J 2/1626
See application file for complete search history.

(56) References Cited

U.S. PATENT DOCUMENTS 8,518,725 B2 8/2013 Terasaki et al.
2018/0179632 A1 6/2018 Teranishi

FOREIGN PATENT DOCUMENTS

JP 2011-161915 A 8/2011

*Primary Examiner* — Lamson D Nguyen
(74) *Attorney, Agent, or Firm* — Venable LLP

(57) ABSTRACT

A liquid ejection head includes: a substrate in which a supply path which opens on a first surface and supplies an ejection liquid is formed; an insulating layer provided on the first surface of the substrate; an energy generating element provided on a surface of the insulating layer; an electric wiring layer electrically connected to the energy generating element and electrically insulated from the ejection liquid by the insulating layer; and an ejection orifice member which forms an ejection orifice and forms a flow path of the ejection liquid from an opening of the supply path to a formation position of the energy generating element. In the vicinity of the opening of the supply path, the insulating layer forms a recessed region by being dented closer to the substrate than the surface on which the energy generating element is provided or by being removed.

10 Claims, 6 Drawing Sheets

LIQUID EJECTION HEAD AND A MANUFACTURING METHOD OF THE SAME

BACKGROUND OF THE INVENTION

Field of the Invention

The present disclosure relates to a liquid ejection head which includes an ejection orifice and ejects a liquid such as an ink from the ejection orifice, and a manufacturing method thereof.

Description of the Related Art

As a liquid ejection head used in a recording apparatus such as an ink jet printer, for example, there is a liquid ejection head which includes a flow path on a substrate on which a supply path is formed as a penetration hole, and applies energy to a liquid in the flow path from an energy generating element to eject the liquid from an ejection orifice. The energy generating element is formed on one surface of the substrate or a surface of a layer which is formed on one surface of the substrate, and the ejection orifice is disposed to oppose to the energy generating element with the flow path interposed therebetween. Among the two opposite surfaces of the substrate, a surface on a side where the energy generating element or the ejection orifice is disposed is referred to as a first surface, and a surface on a side opposite to the first surface is referred to as a second surface. In order to realize high definition recording by disposing a plurality of ejection orifices at a high density to eject a liquid, a silicon semiconductor substrate is used as the substrate, and a semiconductor circuit for driving the energy generating element is formed on the first surface of the substrate. In this case, an insulating layer, in which various electric wiring layers are formed, is deposited on the first surface of the substrate, and the energy generating element is formed on a surface of the insulating layer.

In the liquid ejection head, in order to shorten a time interval of the ejection of the liquid and realize high-speed recording, it is necessary that the flow path on the energy generating element is more rapidly refilled with the liquid, after the ejection of the liquid from the ejection orifice. Japanese Patent Application Laid-Open No. 2011-161915 discloses a liquid ejection head, in which two penetration ports as supply paths are provided for one energy generating element, and a liquid is supplied from both penetration ports to a flow path, to realize rapid refilling of the flow path with the liquid. In this liquid ejection head, the liquid is supplied towards the position of the energy generating element in both directions parallel to the first surface of the substrate, and thus, an ejection direction of the liquid from the ejection orifice is also stable.

SUMMARY OF THE INVENTION

There is provided a liquid ejection head of the disclosure including: a substrate which includes a first surface, and in which a supply path which opens on the first surface and supplies an ejection liquid to a side of the first surface is formed; an insulating layer which is provided on the first surface; an energy generating element which is provided on a surface of the insulating layer and generates energy for ejecting the ejection liquid; an electric wiring layer which is electrically connected to the energy generating element and is electrically insulated from the ejection liquid by the insulating layer; and an ejection orifice member which forms an ejection orifice at a position opposed to the energy generating element and forms a flow path of the ejection liquid from an opening of the supply path to a formation position of the energy generating element, in which, in the vicinity of the opening of the supply path, the insulating layer forms a recessed region by being dented closer to the substrate than the surface on which the energy generating element is provided or by being removed and in the position of the recessed region, the first surface of the substrate is covered with a protective layer formed of a material having a lower etch rate with respect to the ejection liquid, than that of the substrate.

There is also provided a manufacturing method of a liquid ejection head of the disclosure including a substrate which includes a first surface, and in which a supply path which opens on the first surface and supplies an ejection liquid to a side of the first surface is formed, an insulating layer which is provided on the first surface, an energy generating element which is provided on a surface of the insulating layer and generates energy for ejecting the ejection liquid, an electric wiring layer which is electrically connected to the energy generating element and is electrically insulated from the ejection liquid by the insulating layer, an ejection orifice member which forms an ejection orifice at a position opposed to the energy generating element and forms a flow path of the ejection liquid from an opening of the supply path to a formation position of the energy generating element, and a protective layer formed of a material having a lower etch rate with respect to the ejection liquid than that of the substrate, in which, in the vicinity of the opening of the supply path, the insulating layer forms a recessed region by being dented closer to the substrate than the surface on which the energy generating element is provided or by being removed, the method including: (a) preparing the substrate including the insulating layer provided over the entire surface of the first surface, the protective layer disposed on an interface between the substrate and the insulating layer, the energy generating element, and the electric wiring layer; (b) etching the insulating layer in the prepared substrate to form the recessed region in the insulating layer; (c) forming the supply path through the recessed region; and (d) attaching the ejection orifice member to a side of the first surface of the substrate after the step (c), in which the protective layer is provided at least at a position corresponding to the recessed region in the step (a).

Further features of the present disclosure will become apparent from the following description of exemplary embodiments with reference to the attached drawings.

DESCRIPTION OF THE EMBODIMENTS

Figure 1A:
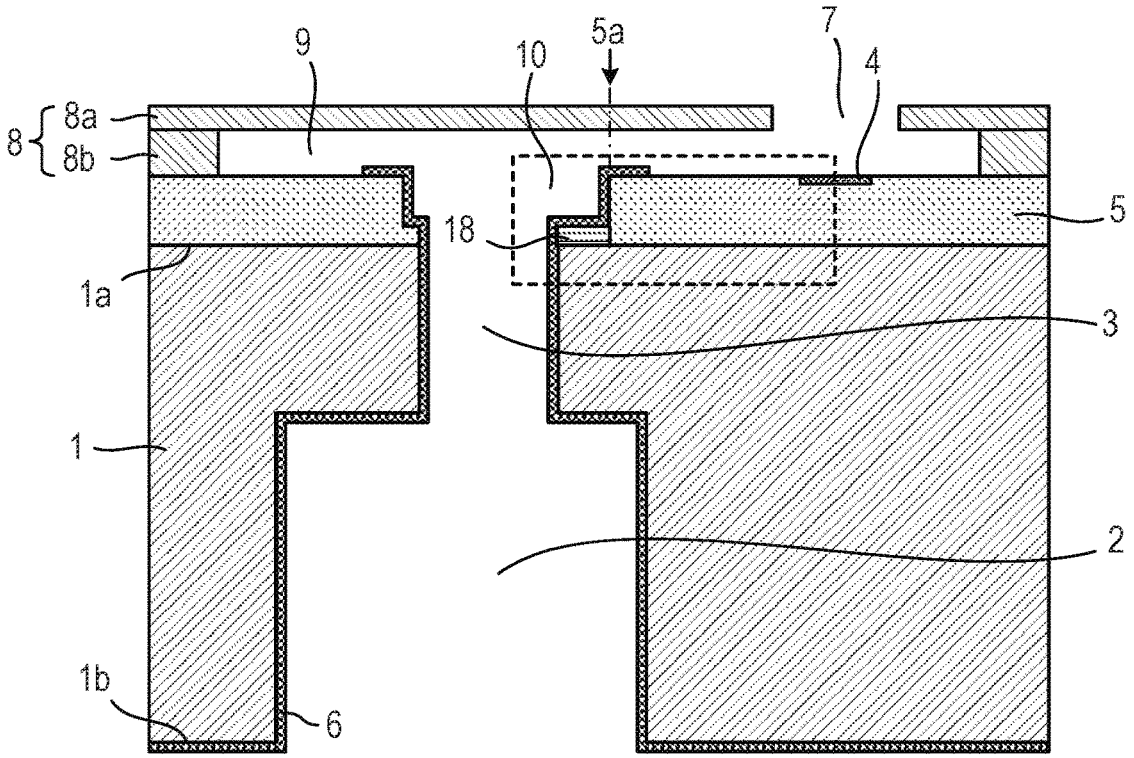
FIGS. 1A and 1B are cross-sectional views explaining a liquid ejection head of Embodiment 1 of the disclosure.

In a case of performing recording at a higher speed than with the liquid ejection head shown in Japanese Patent Application Laid-Open No. 2011-161915, it is necessary that a flow path on an energy generating element is more rapidly refilled with a liquid. In order to realize this, it is effective to reduce a flow resistance by, for example, shortening a distance of the flow path from a supply path provided as a penetration port in the substrate to the energy generating element. It is also thought that, in a liquid ejection head in which an insulating layer is formed on a first surface of the substrate and the energy generating element is provided on a surface of the insulating layer, the insulating layer in the vicinity of the formation position of the penetration port is removed, and a height of the flow path in this region is substantially increased to reduce the flow resistance. An etching process is used for the removal of the insulating layer, and at that time, for example, a silicon substrate can also be used as an etch stop layer. However, in a case where the inventors manufactured such a liquid ejection head in which the insulating layer in the vicinity of the formation position of the penetration port is removed and performed the evaluation, a sufficient result in a long-term reliability was not obtained. Specifically, a test of immersing the liquid ejection head in an ink which is a representative of a liquid to be ejected by the liquid ejection head, that is, the ejection liquid, over a long period of time was performed, and sufficient electrical reliability of the liquid ejection head was not obtained.

Therefore, one aspect of the present disclosure is directed to providing a liquid ejection head in which a flow resistance of a liquid supplied from a supply path to an energy generating element is reduced and a long-term reliability to an ejection liquid is also improved, and a manufacturing method thereof.

Next, embodiments for realizing the disclosure will be described. In the embodiments which will be described below, the disclosure may be specifically described for sufficient explanation, but these are merely technically preferred examples and do not particularly limit the scope of the disclosure.

Before describing the embodiments of the disclosure, the findings made by the present inventors for completing the disclosure will be described. A liquid ejection head in which a silicon semiconductor substrate was used as a substrate, an insulating layer formed of silicon oxide (SiO) and so on was provided on a first surface of the substrate, and an energy generating element was provided on a surface of the insulating layer was manufactured. An electric wiring layer electrically connected to the energy generating element was formed in the insulating layer. In addition, a penetration port which is a supply path was formed so as to penetrate through the substrate and the insulating layer. Here, two types of liquid ejection heads of a liquid ejection head in which the insulating layer was removed in the vicinity of the formation position of the penetration port and the first surface of the substrate was exposed to the portion where the insulating layer was removed, and a liquid ejection head in which the removal of the insulating layer was not performed, were manufactured. In the liquid ejection head in which the removal of the insulating layer is not performed, the penetration port is linked from the substrate to the insulating layer with the same inner diameter. After the manufacturing, these liquid ejection heads were immersed in an ink which is the ejection liquid for a long period of time. The ink was alkaline, and as a result of the long-term immersion, the substrate or the insulating layer which was slowly etched with time was observed.

After the long-term immersion described above, the liquid ejection heads were actually driven by an electric signal and it was observed how long the electrical reliability is ensured. As a result, in the liquid ejection head in which the insulating layer was removed in the vicinity of the formation position of the penetration port, particularly, the period of time for ensuring the electrical reliability could be shortened, compared to the liquid ejection head in which the insulating layer was not removed. It is thought that, such a degradation in electrical reliability is because that the insulating layer in the vicinity of the penetration port is removed to substantially enlarge the supply path, a distance between the supply path and an end portion of the electric wiring layer in the insulating layer is shortened, and the dissolution by the ejection liquid approaches to the end portion of the electric wiring layer in a short period of time. In a case where the alkaline ejection liquid approaches the electric wiring layer, the electric wiring layer may be dissolved or changed in quality.

Embodiment 1

Next, a liquid ejection head of Embodiment 1 of the disclosure will be described. A liquid ejection head is a member provided on a recording apparatus such as an ink jet printer which performs recording on a recording medium by ejecting a liquid. In the recording apparatus, a liquid storage unit which stores a liquid to be supplied to the liquid ejection head, a conveying mechanism of the recording medium, and the like are provided, in addition to the liquid ejection head. The liquid ejection head is generally manufactured using a semiconductor device manufacturing technology.

Figure 1B:
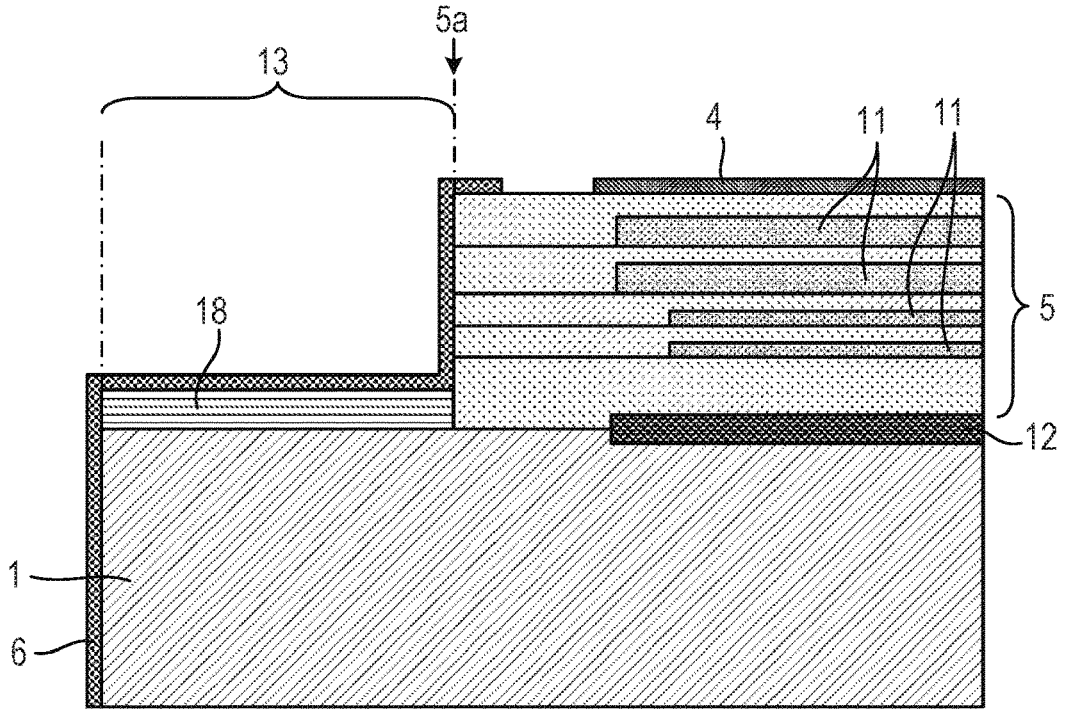

FIGS. 1A and 1B are views illustrating the liquid ejection head of Embodiment 1, in which FIG. 1A is a cross-sectional view and FIG. 1B is an enlarged cross-sectional view of a portion surrounded with a broken line of FIG. 1A. The liquid ejection head includes a substrate 1 formed of silicon (Si), for example. In order to supply a liquid from a second surface 1*b* side of the substrate 1 to a first surface 1*a* side of the substrate 1, a supply path which penetrates through the first surface 1*a* and the second surface 1*b* of the substrate 1 is formed in the substrate 1. In the example illustrated in FIGS. 1A and 1B, this supply path is formed of a first portion 2 opened on the second surface 1*b* and a second portion 3 opened on the first surface 1*a*, and the first portion 2 and the second portion 3 are linked to each other. An insulating layer 5 is provided on the first surface 1*a* of the substrate 1, and an energy generating element 4 which generates energy for ejecting a liquid is formed on an upper surface of the insulating layer 5 in the drawing, that is, a surface on a side opposite to the substrate 1. As illustrated in FIG. 1B, one or a plurality of layers of the electric wiring layers 11 which are electrically connected to the energy generating element 4 are formed in the insulating layer 5. The insulating layer 5 also has a function of electrically insulating the electric wiring layers 11 from the liquid in the liquid ejection head. The energy generating element 4 is, for example, a heating resistor which generates heat by the electric connection and is formed of a thin film of TaSiN. As the electric wiring layer 11, a layer formed of aluminum (Al) is used, for example. Examples of the material constituting the insulating layer 5 include silicon nitride (SiN), silicon carbide (SiC) and silicon oxide (SiO, $SiO_2$). The insulating layer 5 includes an opening 10 having a larger diameter than that of the second portion 3 of the supply path. An opening formed by the penetration of the substrate 1 by the second portion 3 of the supply path is positioned in the opening 10 of the insulating layer 5.

A liquid resistant protective film 6 may be formed on the exposed surface of the substrate 1 and the insulating layer 5. In the example illustrated in FIG. 1B, the liquid resistant protective film 6 is formed on the entire surface of the second surface 1*b* of the substrate 1, the entire surface of an inner wall of the supply path, and a side surface and a bottom surface of the opening 10 formed in the insulating layer 5. The liquid resistant protective film 6 is formed of a material having a lower etch rate with respect to the ejection liquid than those of the substrate 1 and the insulating layer 5, and thus, has a function of preventing corrosion of the substrate 1 and the insulating layer 5. For example, the liquid resistant protective film 6 prevents the dissolving of silicon or the like due to the ejection liquid in the liquid ejection head. Accordingly, the liquid resistant protective film 6 may be provided at a portion affecting the performance or reliability during the usage of the liquid ejection head by the dissolving or corrosion of silicon, among the surface of the silicon exposed in the liquid ejection head. In the substrate 1 on which the supply path is formed as described above, it is preferable that the liquid resistant protective film 6 is formed on the entire exposed silicon surface. In order to form the liquid resistant protective film 6, a film forming method such as a chemical vapor deposition (CVD) method, a sputtering method, an atomic layer deposition (ALD) method can be used according to the structure of the exposed silicon surface. Among these, it is preferable to use the atomic layer deposition method with which excellent adhesiveness to the silicon surface can be ensured. As the material for constituting the liquid resistant protective film 6, for example, a silicon-based material including one or more elements selected from the group consisting of oxygen, nitrogen, and carbon is used. Examples of such a material include SiOC, SiCN, SiOCN and SiON, in addition to simple oxide (SiO), nitride (SiN), and carbide (SiC) of silicon. In a case of increasing corrosion resistance to an alkaline solution, for example, the liquid resistant protective film 6 can also be formed by oxide, nitride, or carbide of a one or more metal elements selected from the group consisting of Ti (titanium), Zr (zirconium), Hf (hafnium), V (vanadium), Nb (niobium), Ni (nickel), and Ta (tantalum). The liquid resistant protective film 6 may be oxide, nitride, or carbide including silicon and the metal element exemplified here. As the metal oxide for forming the liquid resistant protective film 6, for example, titanium oxide (TiO) is preferable.

An ejection orifice member 8, in which an ejection orifice 7 which ejects a liquid is formed, is provided on the first surface 1*a* of the substrate 1. The ejection orifice 7 is formed at a position opposed to the energy generating element 4. In the example illustrated in FIG. 1A, the ejection orifice member 8 is formed by stacking two members of an ejection orifice formation portion 8*a* in which the ejection orifice 7 is actually provided, and a flow path formation portion 8*b* which functions as a spacer so that the ejection orifice 7 is disposed with a predetermined space with respect to the energy generating element 4. The ejection orifice member 8 is, for example, formed of a resin (epoxy resin or the like), silicon, or metal. A region surrounded by the ejection orifice member 8 and the first surface 1*a* side of the substrate 1 is a flow path 9 of the liquid, and particularly, a side wall of the flow path 9 is partitioned by the flow path formation portion 8*b*. A portion including the energy generating element 4 among the flow path 9 is also referred to as a pressure chamber. The ejection orifice 7 is disposed so as to oppose to the energy generating element 4, and the liquid, to which the energy is applied from the energy generating element 4 in the pressure chamber, is ejected from the ejection orifice 7.

As described above, the supply path is constituted of the first portion 2 and the second portion 3. One second portion 3 is, for example, provided for the energy generating element 4, whereas one first portion 2 is provided in common for the plurality of second portions 3. Each of the plurality of second portions 3 is mutually individually provided. Accordingly, the first portion 2 can also be referred to as a common supply path and the second portion 3 can also be referred to as an independent supply path. Here, the supply path is constituted of portions having different shapes, that is, the first portion 2 and the second portion 3, but the supply path may have an entirely uniform shape. For example, an aspect in which one straight supply path penetrating the substrate 1 is formed may be used.

FIG. 1B illustrates an enlarged portion surrounded with a broken line of FIG. 1A, that is, a region from the vicinity of the connection portion to the second portion 3 of the supply path in the opening 10 formed in the insulating layer 5 to the formation position of the energy generating element 4. An oxide film 12 such as a field oxide film is formed on the first surface 1*a* of the substrate 1, and the insulating layer 5 is provided thereon. The insulating layer 5 is a layer formed by stacking a plurality of insulating films, and can be formed, for example, by a plasma CVD method. One or the plurality of electric wiring layers 11 are provided between the plurality of insulating films of the insulating layer 5. The different electric wiring layers 11 are insulated by the insulating films, and these electric wiring layers 11 are electrically connected to each other by a conductive plug (not shown) provided so as to penetrate the insulating films. As the conductive plug, a tungsten (W) plug is used, for example. At least one electric wiring layer 11 is electrically connected to the energy generating element 4, and electric power is supplied to the energy generating element 4 through the electric wiring layer 11.

The second portion 3 of the supply path penetrates through the substrate 1 and the insulating layer 5, and the penetrated portion of the insulating layer 5 is a part of the opening 10 formed in the insulating layer 5. In the consideration of the cross section illustrated in FIGS. 1A and 1B, the insulating layer 5 from the formation position of the energy generating element 4 to the second portion 3 does not extend to a position where the second portion 3 penetrates the substrate 1, and a position in front of the above position is set as an end portion 5*a*, and the insulating layer 5 only extends to the position of this end portion 5*a*. The insulating layer 5 retreats so that the insulating layer 5 does not extend to the position where the second portion 3 of the supply path penetrates the substrate 1, and accordingly, the opening 10 described above having a larger diameter than that of the second portion 3 is formed in the insulating layer 5. As illustrated in FIG. 1B, in a case where the space between the position where the second portion 3 penetrates the substrate 1, and the end portion 5*a* is set as a region 13, the insulating layer 5 is hollowed to reach the substrate 1 in the region 13. That is, the region 13 corresponds to a recessed region which is formed by a dent of the insulating layer 5 to a side of the substrate 1, compared to the surface of the insulating layer 5 where the energy generating element 4 is provided, or a removal of the insulating layer 5 in the vicinity of the opening where the second portion 3 of the supply path is formed in the substrate 1.

In the insulating layer 5, the plurality of electric wiring layers 11 are preferably stacked to each other via the insulating films. By doing so, a thickness of the insulating layer 5 is increased, and as a result, in a case where the end portion 5*a* of the insulating layer 5 retreats from the formation position of the second portion 3 of the supply path as described above, a flow resistance of the liquid is reduced, and an efficiency of refilling of the ejection liquid in the flow path 9 can be further increased. Specifically, the thickness of the insulating layer 5 is preferably 4 μm or more and more preferably 6 μm or more. A thickness of the electric wiring layers 11 included in the insulating layer 5 also contributes to the thickness of the insulating layer 5. An upper limit of the thickness of the insulating layer 5 is not particularly limited, and is preferably 20 μm or less, in a case of considering a general design of the liquid ejection head.

Meanwhile, as described above, in a case where the insulating layer 5 is hollowed and the substrate 1 is exposed to this region, the ejection liquid permeates the silicon constituting the substrate 1, and as a result, a problem of a short period of time for ensuring electrical reliability of the liquid ejection head occurs. Therefore, in the embodiment, a protective layer 18 formed of a material having a lower etch rate to the ejection liquid than that of a material constituting the substrate is formed on the first surface 1*a* of the substrate 1 at least in the region 13 so as to be stuck to the substrate 1. At this time, the protective layer 18 is desirably formed to be adjacent to at least the end portion 5*a* of the insulating layer 5 of the opening 10. The etch rate of the protective layer 18 to the ejection liquid is desirably the same or lower than the etch rate of the insulating layer 5. In the example illustrated in FIGS. 1A and 1B, the liquid resistant protective film 6 is provided so as to also cover the protective layer 18 in the region 13.

Figure 2A:
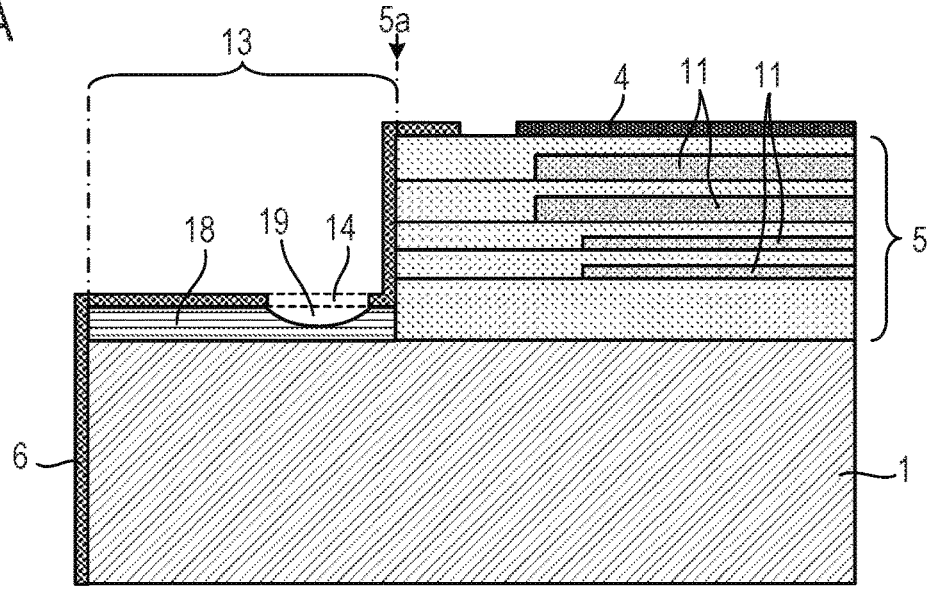
FIGS. 2A, 2B and 2C are cross-sectional views explaining the liquid ejection head of Embodiment 1.

By providing the protective layer 18 as described above, as illustrated in FIG. 2A, the period of time until the ejection liquid approaches the electric wiring layers 11 can be extended, even in a case where the dissolution of the protective layer 18 is started from the region 13 obtained by hollowing the insulating layer 5. That is, it is possible to improve electrical reliability of the liquid ejection head. A reference numeral 14 in the drawings indicates a region where the liquid resistant protective film 6 is removed due to the dissolution, that is, a dissolution portion, and a reference numeral 19 indicates a dissolution portion of the protective layer 18. As a material constituting the protective layer 18, for example, SiC, SiOC, SiCN, SiOCN, SiO, SiN, or SiON which is the same silicon-based material is used, in a case where the silicon is selected for the material of the substrate 1. These materials generally have high electric insulating properties, and therefore, the protective layers 18 can play also a role of interlayer insulation. Accordingly, the same material as the insulating layer may be used for the protective layer 18. In addition, a material different therefrom may be stacked on the interface between the protective layer 18 and the liquid resistant protective film 6.

Figure 2B:
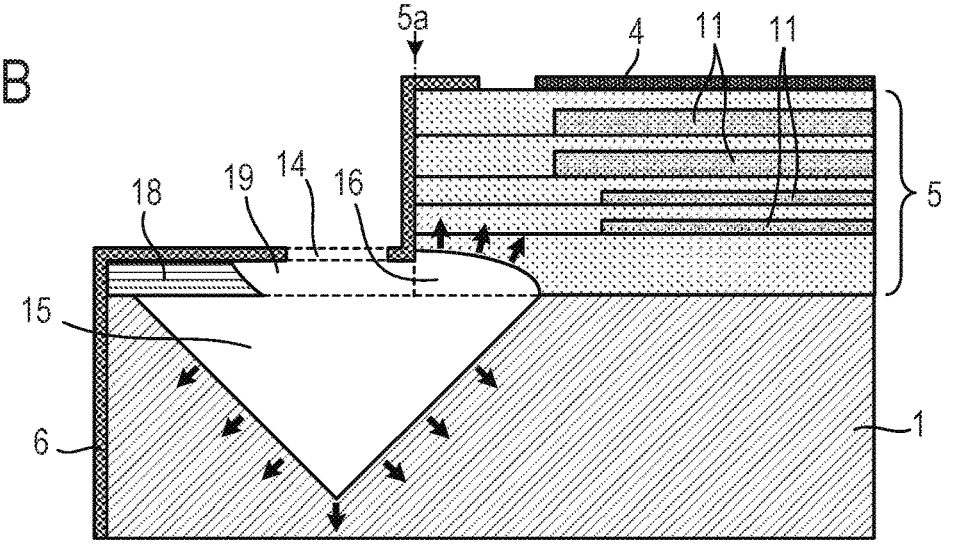
Figure 2C:
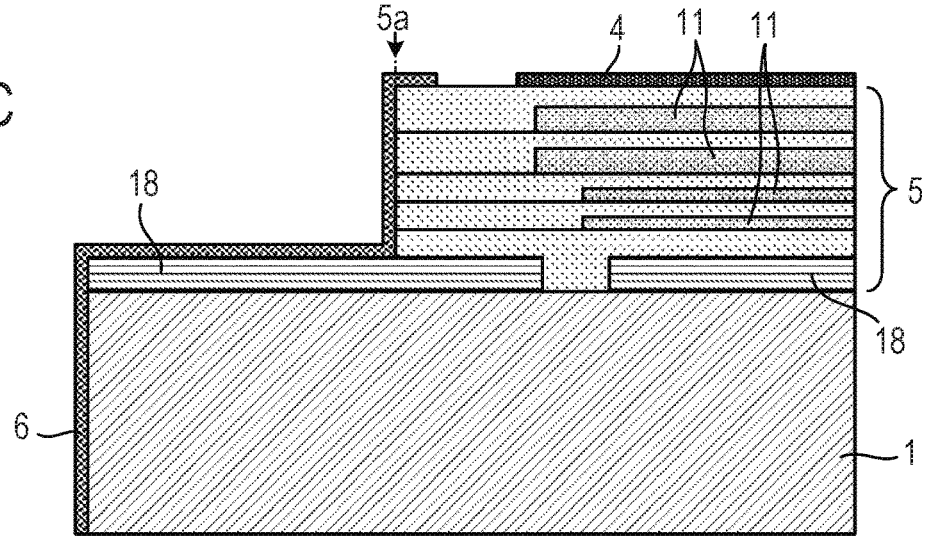

In a case where the protective layer 18 is a material even a slight amount of which is dissolved by the ejection liquid, as illustrated in FIG. 2B, when the protective layer 18 is immersed in the ejection liquid for a long period of time, the ejection liquid eventually approaches the substrate 1 through the protective layer 18, and accordingly, the dissolution of the substrate 1 or the insulating layer 5 also starts. A reference numeral 15 indicates a dissolution portion of the substrate 1 and a reference numeral 16 indicates a dissolution portion of the insulating layer 5. Accordingly, in a case of further improving electrical reliability, as illustrated in FIG. 2C, it is desirable that the protective layer 18 is also formed on the interface between the substrate 1 and the insulating layer 5, not only in the region 13. However, in general, in a case where a thin film formed of different types of materials is stacked and formed on the substrate 1, a warp of the substrate 1 becomes significant, due to a different stress of each material, and the conveyance of the substrate 1 in a semiconductor manufacturing apparatus or the like may be difficult. Therefore, in a case of alleviating the stress, it is preferable to discontinuously provide the protective layer 18 on the interface between the substrate 1 and the insulating layer 5.

Next, a manufacturing step of the liquid ejection head of the embodiment will be described with reference to FIGS. 3A to 3E. First, as illustrated in FIG. 3A, the protective layer 18 is patterned and provided on the first surface of the substrate 1 formed of silicon. After that, the insulating layer 5 formed of a silicon-based material is stacked on the entire surface of the first surface of the substrate 1 including the protective layer 18. In the formation of the insulating layer 5, the electric wiring layers 11 are also formed in the insulating layer 5. Then, the energy generating element 4 is patterned and provided on the surface of the insulating layer 5. At this time, the protective layer 18 is desirably formed of an oxide film, for example, a silicon oxide film. This is because an etch rate of the oxide film to the alkaline ejection liquid is smaller than that of silicon by one severalth to one tenth. In addition, the patterning and forming can be performed at the same time by using a film which already plays a role as an interlayer insulating film, and accordingly, it is not necessary to newly form a layer of a different type of material and it is advantageous in a viewpoint of cost. At this time, a size 22 of the formation region of the protective layer 18 is desirably larger than the region 13 obtained by hollowing the insulating layer 5. It is because, in a case where the protective layer 18 exists on the interface between the substrate 1 and the insulating layer 5, extended from the range of the region 13, the period of time until the ejection liquid approaches the electric wiring layer 11 can be extended, even in a case where a hole linking from the protective layer 18 to the substrate 1 is generated due to the ejection liquid and the dissolution of the substrate 1 has started.

As illustrated in FIG. 3A, an etch stop layer 20 which stops the etching during the etching of the insulating layer 5 may be formed on the protective layer 18. For example, in a case where the oxide film is selected as the protective layer 18 and the insulating layer 5 formed of a silicon-base material is etched, etch rates of both of them are substantially the same, and accordingly, the processing at a high accuracy in a depth direction without exposing the substrate 1 formed of silicon is difficult. In a case where a variation in processing accuracy with respect to the depth direction is large, a variation occurs even in the refilling performance of the ejection liquid to the flow path 9 in the completed liquid ejection head, and this may cause a degradation in recording quality of the liquid ejection head. Therefore, by forming the etch stop layer 20 on the protective layer 18, it is possible to improve the processing accuracy. The etch stop layer 20 may not be formed to be adhered to the protective layer 18. The material constituting the etch stop layer 20 is desirably a material having an etch rate sufficiently lower than that of the insulating layer 5 during the etching of the insulating layer 5, and, for example, polysilicon or polycrystalline silicon carbide can be preferably used. In the liquid ejection head, a sub-heater 21 formed of polysilicon may be provided on the oxide film 12 formed on the first surface of the substrate for the heating or temperature adjustment, the etch stop layer 20 can be formed at the same time with the sub-heater 21. A size 23 of the formation region of the etch stop layer 20 is desirably larger than that of the region 13 obtained by hollowing the insulating layer 5. In a case where the size 23 of the formation region of the etch stop layer 20 is smaller than that of the region 13, the protective layer 18 receives a damage by the etching. For example, in a case where the oxide film is selected for the material of the protective layer 18, the region not covered with the etch stop layer 20 is etched and removed at the same time with the insulating layer 5. In a case of providing the etch stop layer 20 or the sub-heater 21, the etch stop layer 20 or the sub-heater 21 is formed by patterning, and then the insulating layer 5 is provided over the entire surface.

Figure 3D:
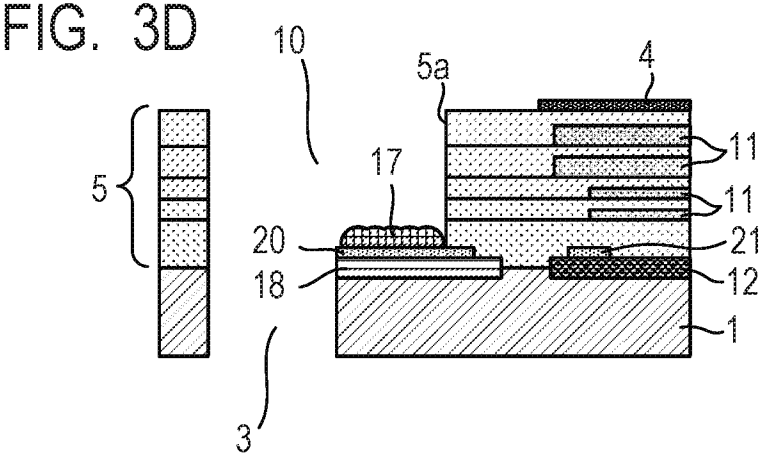
FIGS. 3A, 3B, 3C, 3D and 3E are cross-sectional views illustrating a manufacturing step of the liquid ejection head of Embodiment 1.
Figure 3E:
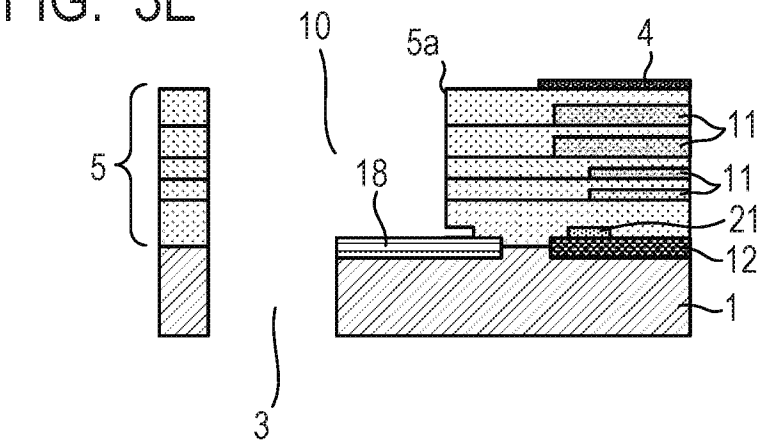
Figure 3A:
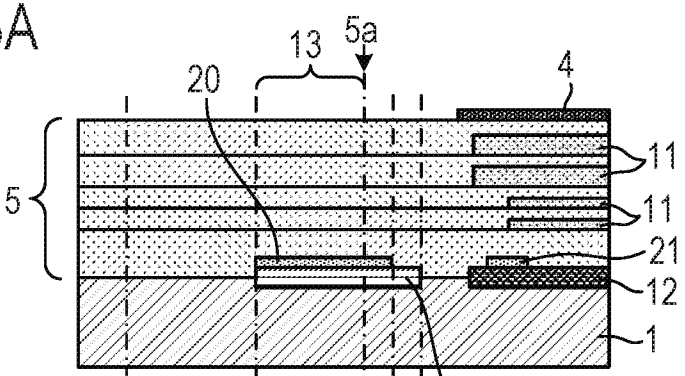
Figure 3B:
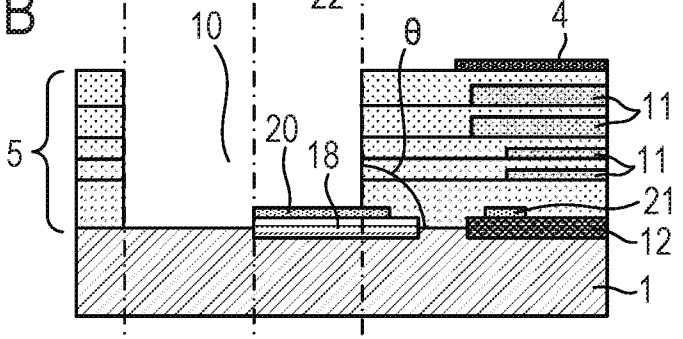

Then, as illustrated in FIG. 3B, the opening 10 of the insulating layer 5 is formed by etching the insulating layer 5. As a method of forming the opening 10, reactive ion etching (RIE) is preferably used. In a case where the insulating layer 5 is constituted of a plurality of insulating films, the reactive ion etching is particularly preferably used. In a case of using the reactive ion etching, for example, first, a positive type resist is applied on the insulating layer 5, and this is patterned by exposure, heating, and development, and a mask is formed. This heating is preferably performed at 90° C. or higher to 120° C. or lower. Under this condition, a taper of the opening of the mask can be 90 degrees or more. In a case of performing the reactive ion etching using such a mask, an angle of the end portion 5*a* of the insulating layer 5 is less than 90 degrees so that the opening 10 becomes a tapered shape which is narrowed in the depth direction, and the end portion 5*a* can be a slope inclined with respect to the first surface of the substrate 1. By setting the end portion of the insulating layer 5 to be such a slope, a flow of the liquid towards the energy generating element 4 can be set to be excellent. An angle θ formed by the slope which is the end portion 5*a* of the insulating layer 5 and the surface of the substrate 1, that is, an angle of the end portion 5*a* measured on the side of the interface with the substrate 1 where the insulating layer 5 exists, is preferably 45 degrees or more to less than 90 degrees. By setting the angle to be less than 90 degrees, a shape of the end portion 5*a* is a slope which is inclined with respect to the surface of the substrate 1. On the other hand, in a case where the angle θ of the end portion 5*a* is less than 45 degrees, the end portion 5*a* is excessively inclined, and the electric wiring layer 11 or the like in the insulating layer 5 may be affected. In addition, it is preferable to shorten a distance between the end portion 5*a* and the energy generating element 4 by setting the angle θ to be 45 degrees or more, from a viewpoint of an efficiency of refilling of the flow path 9 with the liquid.

In a case of performing the reactive ion etching with respect to the insulating layer 5 using a mask having the shape described above, a mixed gas of $C_4F_8$, $CF_4$ and Ar can be used, for example, as a gas used in the etching. Particularly, the etching by the reactive ion etching using an inductively coupled plasma (ICP) device is preferably performed. However, a reactive ion etching device including other types of plasma sources may be used. For example, an electron cyclotron resonance (ECR) device or a magnetic neutral loop discharge (NLD) plasma device may be used in the reactive ion etching.

Figure 3C:
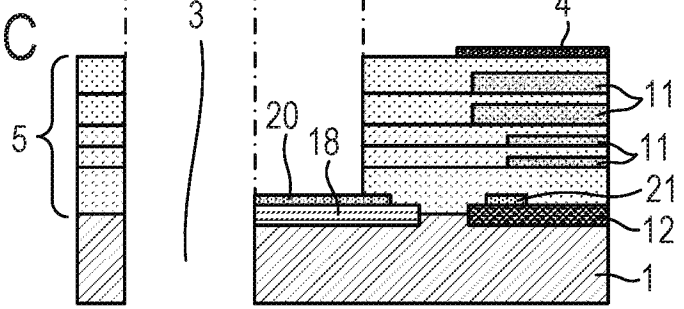

Next, as illustrated in FIG. 3C, a supply path is formed in the substrate 1. In FIG. 3C, only the second portion 3 of the supply path is illustrated, but the first portion 2 is separately formed. As a formation method of the supply path, for example, dry etching or crystal anisotropic etching using a photosensitive resin as a mask is used, but the dry etching is suitable. Among these, a Bosch process that is excellent as a depth etching technology of silicon can be preferably used. The Bosch process is a method of anisotropically etching silicon by repeating the formation of a deposition film having carbon as a main component and the etching by an $SF_6$ gas or the like. In this etching, a mask used in the formation of the opening 10 functions as an etching mask, and the protective layer 18 and the etch stop layer 20 existing on the bottom surface of the opening 10 function as the etching mask. After performing these etching, the mask used in the formation of the opening 10 is not necessary, and thus, the mask is removed.

As illustrated in FIG. 3D, in a case of etching the insulating layer 5 for forming the opening 10, a residue 17 may be deposited on the surface layer of the etch stop layer 20. In a case where the substrate 1, the protective layer 18 and the insulating layer 5 are covered with the liquid resistant protective film 6, this residue 17 is a reason for a degradation in adhesiveness with the liquid resistant protective film 6. Therefore, as illustrated in FIG. 3E, by removing the etch stop layer 20, the residue 17 is preferably lifted off together with the etch stop layer 20. For example, in a case where the polysilicon is selected to be used in the etch stop layer 20 and the removing is performed by wet etching, a mixed solution of hydrofluoric acid and nitric acid or tetramethylammonium hydroxide (TMAH) aqueous solution can be used. In a case of using the dry etching, a mixed gas of chlorine ($Cl_2$) and hydrogen bromide (HBr) or the like can be used. After removing the residue 17, the substrate 1, the protective layer 18, and the insulating layer 5 are covered with the liquid resistant protective film 6. Accordingly, even in a case where a crack or the like is generated on the liquid resistant protective film 6 formed in the region 13 and the dissolution due to the ejection liquid is started, it is possible to improve the processing accuracy with respect to the depth direction of the insulating layer while decreasing the dissolution speed thereof. As a result, according to Embodiment 1, the liquid ejection head in which the flow resistance of the liquid supplied from the supply path to the energy generating element 4 is reduced, and the long-term reliability with respect to the ejection liquid is improved can be obtained.

Figure 4:
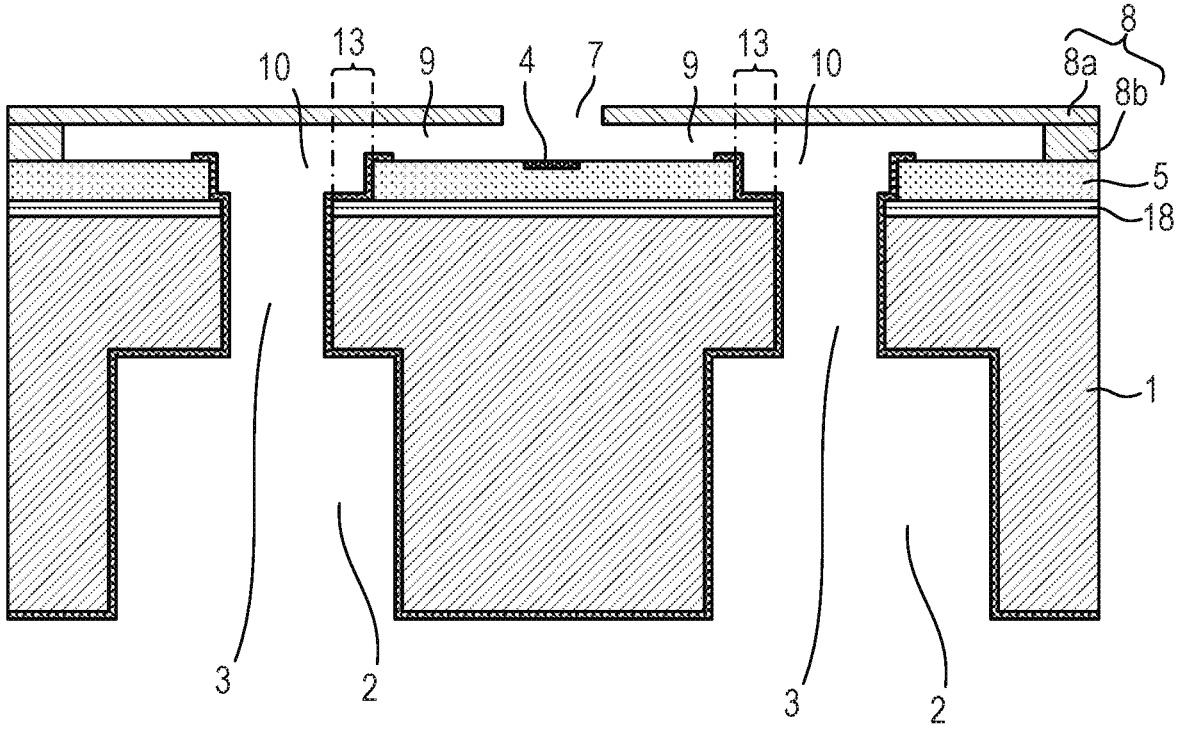
FIG. 4 is a cross-sectional view illustrating another example of the liquid ejection head of Embodiment 1.

The liquid ejection head according to the disclosure may have a configuration in which the supply path is provided on both sides of the energy generating element 4 so that the energy generating element 4 is sandwiched. FIG. 4 illustrates an example of such a liquid ejection head. In this liquid ejection head, the second portion 3 of the supply path is opened on both sides of the formation position of the energy generating element 4 on the first surface side of the substrate 1. The position of the end portion of the insulating layer 5 is a position close to the formation position side of the energy generating element 4 from the edge of the opening by the penetration through the substrate 1 by the second portion 3 of the supply path, in each region on both sides of the energy generating element 4 in the drawing.

Embodiment 2

In the liquid ejection head according to the disclosure, the insulating layer 5 stacked on the substrate 1 can be set as the protective layer. In this case, in a case of etching the insulating layer 5 for forming the opening 10, it is necessary to perform the etching so that the etching approaches the substrate 1 at the position where the second portion 3 of the supply path penetrates the substrate 1 and the etching finishes while the etching does not approach the substrate 1 in the region 13. As the etch stop layer necessary for performing such etching, a metal film formed at the same time as the electric wiring layer 11 provided in the insulating layer 5 can be used. As Embodiment 2, FIGS. 5A to 5D illustrate a manufacturing method of a liquid ejection head using the metal film formed at the same time as the electric wiring layer 11 provided in the insulating layer 5 as the etch stop layer 20.

Figure 5A:
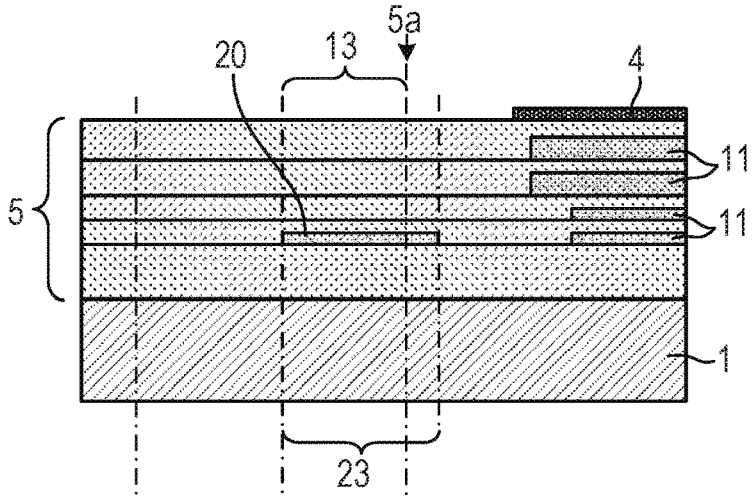
FIGS. 5A, 5B, 5C and 5D are cross-sectional views illustrating a manufacturing step of a liquid ejection head of Embodiment 2 of the disclosure.

First, as illustrated in FIG. 5A, the substrate 1 in which the insulating layer 5, the electric wiring layer 11 and the energy generating element 4 are formed is prepared. The material or the like used in the substrate 1, the insulating layer 5, the electric wiring layer 11, and the energy generating element 4 is the same as in Embodiment 1, but it is important that at least a dissolution speed of the material of the insulating layer 5 adhered to the substrate 1 with respect to the ejection liquid is higher than that of the substrate 1. For example, in a case where the silicon is used for the substrate 1 and the ejection liquid is an alkaline ink, the silicon-based material described in Embodiment 1 can be selected as the insulating layer 5. A metal film can be used as the etch stop layer 20 during the etching of the insulating layer 5, and particularly, the material formed at the same time as the electric wiring layer 11 can be used. As this material, aluminum or the like is preferably selected.

Figure 5B:
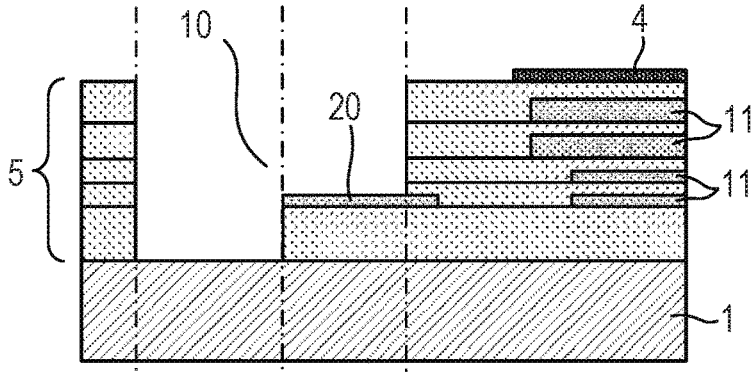
Figure 5C:
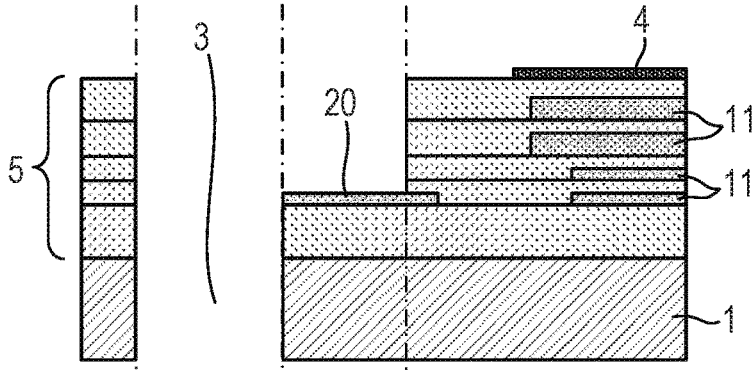
Figure 5D:
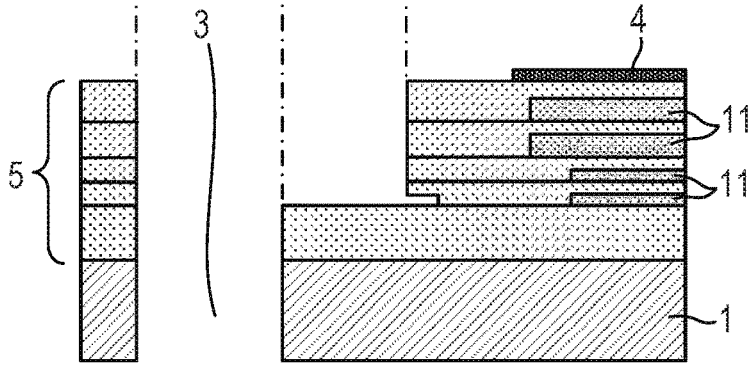

Next, as illustrated in FIGS. 5B and 5C, the insulating layer 5 and the substrate 1 are etched to form the supply path. In the drawings, the second portion 3 is drawn as the supply path. The method used in the etching is the same as that in Embodiment 1, but a component corresponding to the opening 10 to be formed in the insulating layer 5 is used as a mask used in the etching. As a result, in a region where the etch stop layer 20 is formed, that is, in the region 13, the etching finishes at the position of the etch stop layer 20, and in the other regions, the insulating layer 5 is etched and removed to the first surface of the substrate 1, and the substrate 1 is also etched. Then, as illustrated in FIG. 5D, the etch stop layer 20 may be removed. In a case where aluminum is used as the etch stop layer 20, the removal can be performed with an alkaline or acidic chemical. For example, in the same manner as in Embodiment 1, tetramethylammonium hydroxide can be used. In Embodiment 2, the liquid ejection head can also be manufactured by the same procedure in Embodiment 1.

By the method described in Embodiment 2, a material having resistance to the ejection liquid can be disposed in the region 13, and accordingly, the period of time until the ejection liquid approaches the electric wiring layer 11 can be extended. In Embodiment 1 described above, as the material having a lower dissolution speed by the ejection liquid than that of the substrate 1, a different type of material formed on the substrate 1 was used as the protective layer 18, and another different type of material stacked and formed on the protective layer 18 was used as the etch stop layer 20. Even in a case where such a different type of material cannot be prepared, it is possible to obtain a liquid ejection head having reduced flow resistance and improved long-term reliability with respect to the ejection liquid, by applying Embodiment 2, in a case where the material stacked and formed on the substrate 1 has resistance to the ejection liquid.

Hereinabove, Embodiment 1 and Embodiment 2 of the disclosure have been described, but the configurations shown in Embodiment 1 and Embodiment 2 are not limited to be realized independently, and these embodiments can be used in suitable combination.

Examples

Figures 6A, 6B, 6C, 6D, 6E, 6F, 6G, 6H, 6I:
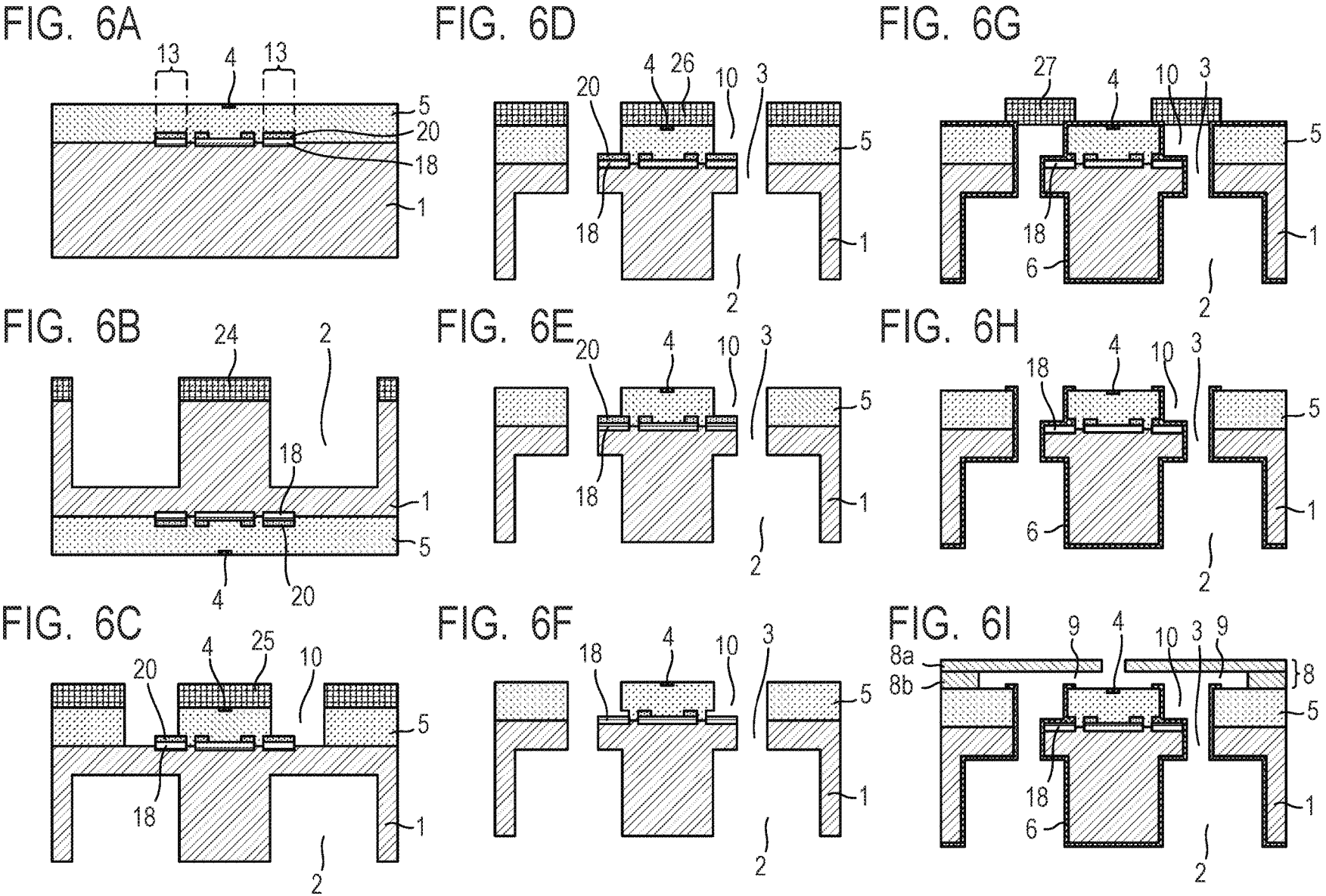
FIGS. 6A, 6B, 6C, 6D, 6E, 6F, 6G, 6H and 6I are cross-sectional views illustrating a manufacturing step of the liquid ejection head of an example.

Hereinafter, the disclosure will be described more specifically with reference to the example in which the liquid ejection head described with reference to FIGS. 3A to 3E in Embodiment 1 is actually manufactured. However, in the liquid ejection head, as illustrated in FIG. 4, the second portion 3 of the supply path is respectively provided on both sides of the energy generating element 4. FIGS. 6A to 6I illustrate a manufacturing steps of the liquid ejection head in this example. First, as illustrated in FIG. 6A, the substrate 1 which is a single crystal substrate of silicon was prepared. This substrate 1 is a substrate in which the insulating layer 5 formed of silicon oxide is stacked over the entire surface of the first surface, and the energy generating element 4 formed of TaSiN is provided on the surface of the insulating layer 5. Although not illustrated in FIGS. 6A to 6I, in the same manner as in each embodiment described above, four electric wiring layers 11 formed of aluminum were provided in the insulating layers 5, as the configuration of the insulating layer 5 in which the plurality of insulating films are stacked. In the electric connection between the electric wiring layers 11, a conductive plug (not illustrated) formed of tungsten was used. An entire thickness of the insulating layer 5 was 10 μm. In addition, the protective layer 18 formed of an oxide film was discontinuously provided at a position of the interface between the first surface of the substrate 1 and the insulating layer 5, and the etch stop layer 20 and the sub-heater 21 were also provided on the protective layer 18.

Next, as shown in FIG. 6B, an etching mask 24 was provided on the second surface on a side opposite to the first surface in the substrate 1, and the first portion 2 of the supply path was formed by the reactive ion etching. The etching mask 24 was formed of silicon oxide. A depth of the first portion 2 was 500 μm, and as a gas, $SF_6$ was used in the etching step, and $C_4F_8$ was used in the coating step. In both steps, a gas pressure was set as 10 Pa and a gas flow rate was set as 500 sccm. sccm is a unit representing the flow rate per minute converted to a standard state in terms of $cm^3$. An etching period of time was set as 20 seconds, a coating period of time was set as 5 seconds, and a platen power of 150 W was applied for 10 seconds during the etching time. This is an etching method called the Bosch process among the methods of reactive ion etching.

Then, the etching mask 24 was removed, and as illustrated in FIG. 6C, an etching mask 25 for providing the opening 10 was provided on the first surface side of the substrate 1. The etching mask 25 was formed by applying a novolak positive type resist at a thickness of 20 μm, pre-baking at 150° C., and then performing the exposure and development by slightly defocusing the focus during the exposure on 5 μm from the resist top. The insulating layer 5 was etched by the reactive ion etching and the opening 10 was formed in the insulating layer 5. The reactive ion etching was performed by using a mixed gas of $C_4F_8$, $CF_4$ and Ar, at a flow rate of this mixed gas of 10 sccm and a platen power of 100 W. When the etching of the insulating layer 5 proceeds, the etching region (etching gas) approaches the etch stop layer 20 on the first surface side of the substrate 1. A selection ratio of the insulating layer 5, and the substrate 1 and the etch stop layer 20 in the etching here was 100 or more, and accordingly, in a case where the etching region has approached the substrate 1, the etch rate is excessively decreased, and thus, the etching was finished at this point. In this stage, the opening 10 was formed in the insulating layer 5.

Next, as illustrated in FIG. 6D, after removing the etching mask 25, an etching mask 26 for forming the second portion 3 of the supply path was formed on the first surface side of the substrate 1. The etching mask 26 was formed using a novolak positive type resist to have a film thickness of 20 μm, and patterned by photolithography. Then, the reactive ion etching was performed with respect to the substrate 1 and the second portion 3 of the supply path was formed. After that, as illustrated in FIG. 6E, the etching mask 26 was removed. Then, as illustrated in FIG. 6F, the etch stop layer 20 in the opening 10 was removed by the wet etching and the protective layer 18 was exposed. As an etching solution in the wet etching, a tetramethylammonium hydroxide aqueous solution was used. At this time, an organic residue deposited on the surface layer of the etch stop layer 20 by the resist work could also be removed together with the etch stop layer 20.

Next, by forming a film of titanium oxide (thickness: 100 nm) on the substrate 1 by an atomic layer deposition method film forming device, the liquid resistant protective film 6 was formed so as to cover the substrate 1, the insulating layer 5 and the protective layer 18. By using the atomic layer deposition method, the liquid resistant protective film 6 could be formed on an inner wall of the supply path provided as the penetration hole in the substrate 1 to have a substantially even thickness. After that, as illustrated in FIG. 6G, an etching mask 27 was formed on the first surface side of the substrate 1 so as to cover only the opening 10 and the peripheral portion thereof. By performing the wet etching with respect to the first surface side of the substrate 1 in this state, an unnecessary portion of the liquid resistant protective film 6 on the first surface side of the substrate 1 was removed. For an etching solution of the wet etching, buffered hydrofluoric acid was used. After that, as illustrated in FIG. 6H, the etching mask 27 was removed. Finally, as illustrated in FIG. 6I, a dry film including an epoxy resin with respect to the first surface of the substrate 1 was attached to the substrate 1, patterned, exposed, and developed, and accordingly, the ejection orifice member 8 for forming the flow path 9 and the ejection orifice 7 was formed on the first surface side of the substrate 1. Therefore, the liquid ejection head is completed.

An ink immersion test was performed with respect to an individual piece of the completed liquid ejection head substrate before forming the ejection orifice member 8. As a result, it could be confirmed that, even in a case where the ink penetrated the side of the substrate 1 or the insulating layer 5 from the region 13 obtained by hollowing of the insulating layer 5, the period of time until the dissolution approaches the electric wiring layer 11 was extended, and electrical reliability was improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-235392, filed Dec. 17, 2018, which is hereby incorporated by reference herein in its entirety.

What is claimed is:

1. A liquid ejection head comprising:

a substrate which includes a first surface, and in which a supply path which opens on the first surface and supplies an ejection liquid to a side of the first surface is formed;

an insulating layer which is provided on the first surface;

an energy generating element which is provided on a surface of the insulating layer and generates energy for ejecting the ejection liquid;

an electric wiring layer which is electrically connected to the energy generating element and is electrically insulated from the ejection liquid by the insulating layer; and an ejection orifice member which forms an ejection orifice at a position opposed to the energy generating element and forms a flow path of the ejection liquid from an opening of the supply path to a formation position of the energy generating element, wherein, in a vicinity of the opening of the supply path, the insulating layer forms a recessed region by being dented closer to the substrate than the surface on which the energy generating element is provided or by being removed, and wherein, in a position of the recessed region, the first surface of the substrate is covered with a protective layer formed of a material having a lower etch rate with respect to the ejection liquid, than that of the substrate.

2. The liquid ejection head according to claim 1, wherein a plurality of electric wiring layers are provided, and wherein the plurality of electric wiring layers are provided in the insulating layer and stacked to each other via an insulating film constituting the insulating layer.

3. The liquid ejection head according to claim 1, wherein the insulating layer is formed of at least one of silicon nitride, silicon carbide and silicon oxide.

4. The liquid ejection head according to claim 1, wherein the protective layer is also formed on an interface between the first surface and the insulating layer.

5. The liquid ejection head according to claim 4, wherein the protective layer is formed at least in a region from the position of the recessed region to a position corresponding to the formation position of the energy generating element in the interface.

6. The liquid ejection head according to claim 4, wherein the protective layer is discontinuously formed at least in the interface.

7. The liquid ejection head according to claim 1, wherein the protective layer is formed of at least one of silicon nitride, silicon carbide and silicon oxide.

8. The liquid ejection head according to claim 1, wherein the protective layer and the insulating layer are formed of the same material.

9. The liquid ejection head according to claim 1, wherein at least a part of surfaces of the substrate, the insulating layer, and the protective layer is covered with a liquid resistant protective film having a resistance to the ejection liquid.

10. The liquid ejection head according to claim 9, wherein the liquid resistant protective film is formed of any of oxide, nitride, or carbide of one or more elements selected from the group consisting of silicon, titanium, zirconium, hafnium, vanadium, niobium, nickel and tantalum.

* * * * *